US009650847B2

(12) United States Patent
Gourmelon

(10) Patent No.: US 9,650,847 B2
(45) Date of Patent: May 16, 2017

(54) METHOD AND APPARATUS TO ENABLE TOOLSTRING TO NEGOTIATE OBSTRUCTIONS DOWNHOLE

(71) Applicant: Schlumberger Technology Corporation, Sugar Land, TX (US)

(72) Inventor: Pierre O. Gourmelon, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 217 days.

(21) Appl. No.: 14/037,827

(22) Filed: Sep. 26, 2013

(65) Prior Publication Data

US 2015/0083437 A1 Mar. 26, 2015

(51) Int. Cl.
*E21B 17/10* (2006.01)
*E21B 23/14* (2006.01)

(52) U.S. Cl.
CPC ..... *E21B 17/1057* (2013.01); *E21B 17/1014* (2013.01); *E21B 17/1078* (2013.01); *E21B 23/14* (2013.01)

(58) Field of Classification Search
CPC ..... E21B 17/1014; E21B 17/1021; E21B 17/1057; E21B 17/12; E21B 17/10; E21B 17/1078; E21B 23/14
See application file for complete search history.

(56) References Cited

U.S. PATENT DOCUMENTS

| | | | | |
|---|---|---|---|---|
| 1,898,074 | A * | 2/1933 | Bailey | 175/325.7 |
| 4,830,105 | A | 5/1989 | Petermann | |
| 5,355,950 | A | 10/1994 | Zwart | |
| 5,765,640 | A * | 6/1998 | Milne | E21B 17/1021 166/206 |
| 6,401,812 | B2 | 6/2002 | Leising | |
| 6,920,936 | B2 | 7/2005 | Sheiretov et al. | |
| 7,188,671 | B2 | 3/2007 | Al-Zahrani | |
| 7,334,642 | B2 | 2/2008 | Doering et al. | |
| 7,757,782 | B2 | 7/2010 | Tashiro et al. | |
| 7,854,258 | B2 * | 12/2010 | Sheiretov | E21B 4/18 166/301 |
| 2006/0157246 | A1 | 7/2006 | Zeer | |
| 2008/0135293 | A1 | 6/2008 | Tashiro et al. | |
| 2011/0138903 | A1 * | 6/2011 | Large | E21B 17/1021 73/152.17 |
| 2012/0061098 | A1 | 3/2012 | Hall | |
| 2012/0205093 | A1 * | 8/2012 | Paszek | 166/241.6 |
| 2012/0239345 | A1 * | 9/2012 | Fraser et al. | 702/157 |

(Continued)

FOREIGN PATENT DOCUMENTS

WO 2013067255 A1 5/2013

OTHER PUBLICATIONS

International Search Report and the Written Opinion for International Application No. PCT/US2014/057493 dated Jan. 7, 2015.

*Primary Examiner* — David Bagnell
*Assistant Examiner* — Michael Goodwin
(74) *Attorney, Agent, or Firm* — Trevor G. Grove

(57) ABSTRACT

An apparatus to allow a toolstring to negotiate obstructions in a well includes an elongated body, a centralizer connected with the elongated body; and a nose connected with an end of the elongated body. The nose actuates the centralizer when moved towards the centralizer.

12 Claims, 6 Drawing Sheets

(56) References Cited

U.S. PATENT DOCUMENTS

| | | | | |
|---|---|---|---|---|
| 2013/0299188 | A1* | 11/2013 | Ahmed et al. | 166/381 |
| 2014/0238659 | A1* | 8/2014 | Wheater | E21B 23/14<br>166/85.5 |
| 2015/0083406 | A1* | 3/2015 | Nelson | E21B 4/18<br>166/250.01 |

* cited by examiner

METHOD AND APPARATUS TO ENABLE TOOLSTRING TO NEGOTIATE OBSTRUCTIONS DOWNHOLE

CROSS-REFERENCE TO RELATED APPLICATIONS

None.

FIELD OF THE DISCLOSURE

The disclosure generally relates to an apparatus, system, and method of enabling a toolstring to negotiate obstructions in a well.

BACKGROUND

During well operations it is often necessary to deploy toolstrings into a well. The toolstrings provide the tools required to service the well or perform other operations within the well. Wireline, slickline, and other cables are often used to convey the toolstring. Wells may, however, develop washouts or have other obstructions making it difficult to convey the toolstring.

A need, therefore, exists for an apparatus and method of negotiating obstructions in a well, allowing the toolstring to be deployed without the use of auxiliary conveyance devices.

SUMMARY

An embodiment of an apparatus to allow a toolstring to negotiate obstructions in a well includes an elongated body. The elongated body has a centralizer and a nose connected therewith. The nose can be connected with an end of the elongated body. The nose is configured to actuate the centralizer when moved towards the centralizer.

An embodiment of a method of negotiating obstructions while running a toolstring in a well includes running a toolstring into a well, and encountering an obstruction in the well. The obstruction applies an axial force to a nose of an apparatus located at the distal end of the toolstring, and the axial force moves the nose, actuating a centralizer.

An embodiment of a system for use in a well includes a toolstring. An apparatus is connected with the toolstring. The apparatus allows the toolstring to negotiate obstructions in a well. The apparatus comprises an elongated body; a centralizer connected with the elongated body; and a nose connected with an end of the elongated body. The nose actuates the centralizer when moved towards the centralizer.

DETAILED DESCRIPTION OF THE INVENTION

Figure 1:
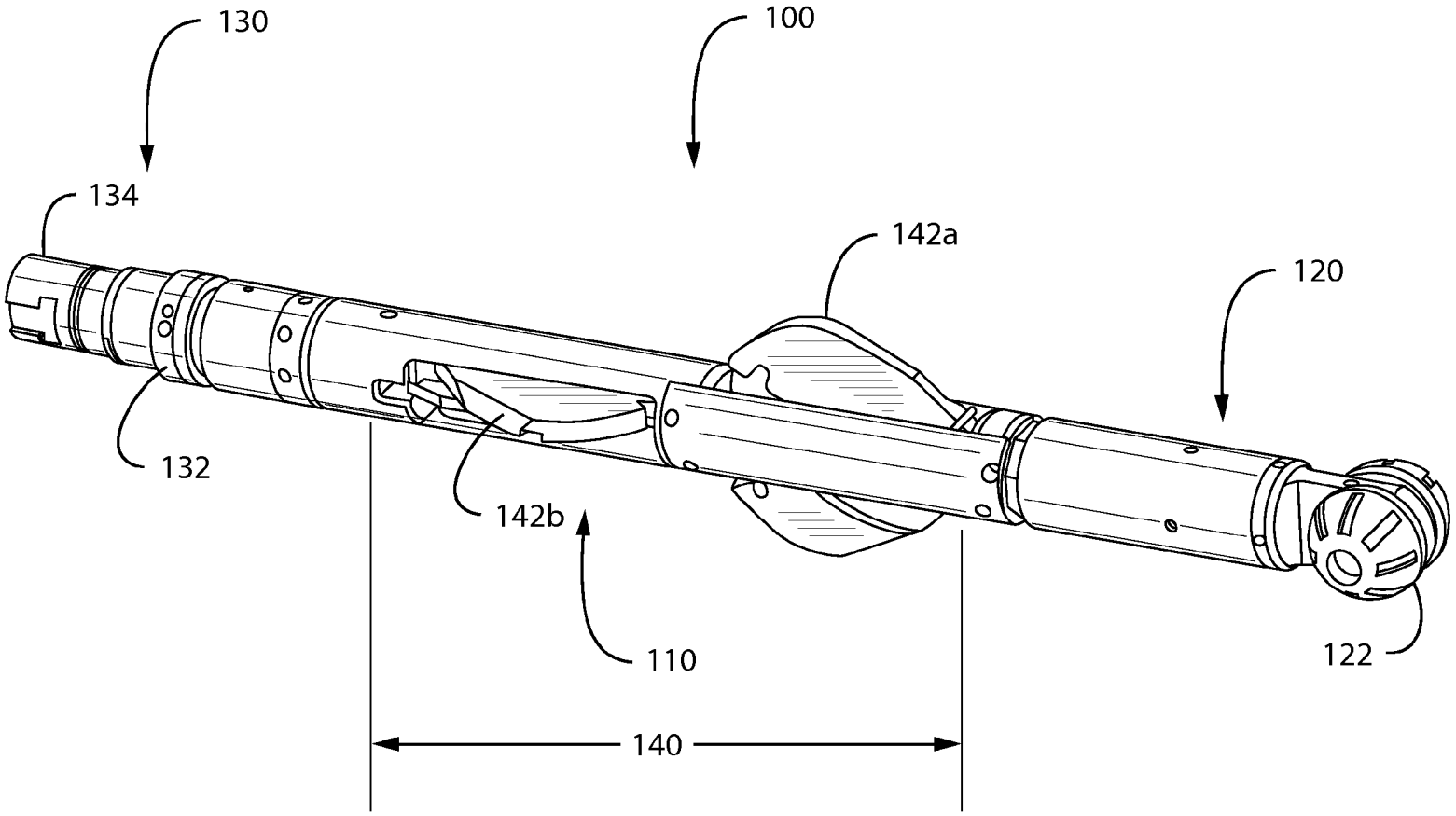
FIG. 1 depicts an embodiment of the apparatus.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example apparatus to allow a toolstring to negotiate obstructions in a well includes a nose and centralizer connected with an elongated body. The nose can be connected with the elongated body and configured to move relative to the elongated body.

The centralizer can be a bow spring, a plurality of arms that radially extend from within the elongated body; or another mechanically actuated centralizing device.

In an embodiment, the plurality of arms can have wheels located at the ends thereof. The arms can be set up as two pairs, with the leading pair sweeping backwards and the trailing pair sweeping forwards, enabling the arms to avoid self-locking while running into the well, or pulling out of the well.

The nose can be configured to move towards the centralizer and actuate the centralizer. For example, the nose can have a shoulder that transfers force applied to the nose from an obstruction in a well to a bow spring centralizer; thereby, expanding the bow spring centralizer.

In another, but non-limiting, example the nose can have rods, sliding sleeves, or the like operatively connected therewith, and the rods, sliding sleeves, or the like can engage sliders located in the elongated body; thereby, transmitting force to the sliders; the sliders can be connected with a plurality of arms and can rotate the arms from within the elongated body.

The nose can have any configuration that allows the nose to actuate the centralizer when axial force is applied to the nose by an obstruction in the well. One skilled in the art would be able to identify such configurations without undue experimentation with the aid of this disclosure.

In embodiments, the arms can be extended by pegs which slide in the axial direction of the tool as the nose is compressed. These pegs push against a slot in each arm. The slots on the rear arms are set in the opposite direction as all four pegs move together. These pegs are actuated by the nose as the nose moves towards the arms. For example, the nose can have sliding sleeves or push rods connected therewith that push on the pegs.

In an embodiment of the apparatus, a return mechanism can be located between the nose and the centralizer. The return mechanism can be any device capable of storing potential energy and converting the potential energy into kinetic energy to return the nose after axial force from the obstruction is removed from the nose. An illustrative return mechanism is a spring.

In an embodiment of the apparatus, the nose can be located at one end of the elongated body and a connection member can be located at another end of the elongated body. The connection member can be configured to connect the apparatus to a toolstring and allow the nose and elongated body to move radially relative to the toolstring. For example, the connection member can be a ball joint hinge or other similar connection.

An example system for use in a well can include a toolstring. The toolstring can include components or tools for performing operations in a well. The toolstring can be connected with an apparatus. The apparatus can allow or aid the toolstring in negotiating the well. The toolstring can be used in horizontal, deviated, and vertical wells. The system can be used in cased wells and open hole wells. The toolstring can be deployed using a cable operatively connected with a deployment device.

Turning now to the FIGS, FIG. 1 depicts an embodiment of the apparatus. The apparatus 100 can have an elongated body 110. A connection member 130 and a nose 120 can be connected with the elongated body 110. A centralizer 140 can be located on the elongated body 110.

The connection member 130 can have a connection end 134 and a ball joint 132 at another end. The ball joint 132 connects with the elongated body 110 and the connection member 130 connects with a toolstring or other tubular member.

The nose 120 is connected with the elongated body 110 and is configured to axially move with respect to the elongated body 110. The nose 120 is configured to move towards the centralizer 140 and actuate the centralizer 140 using mechanical force. A pair of rollers 122 can be connected with the nose 120. The pair of rollers 122 can reduce friction at the nose 120. The rollers can be a pair of hemispheres that are elongated a bit to favor a lower friction roller position (e.g. with the surface of contact parallel to the roller's axle). Also, the size of the rollers can be sized to cater to different hole sizes while acting as a centralizer.

The centralizer 140 can be any device that can be radially expanded to center the apparatus 100 within a well. The centralizer, in FIG. 1, is depicted as a first pair of arms 142*a* and a second pair of arms 142*b*. The pairs of arms 142*a* and 142*b* can be radially expanded to center the apparatus 100. The pairs of arms 142*a* and 142*b* can rest or reside in whole or part in the elongated body 110 when not expanded. In an embodiment, the arms can have hardened skids located thereon.

Figure 2:
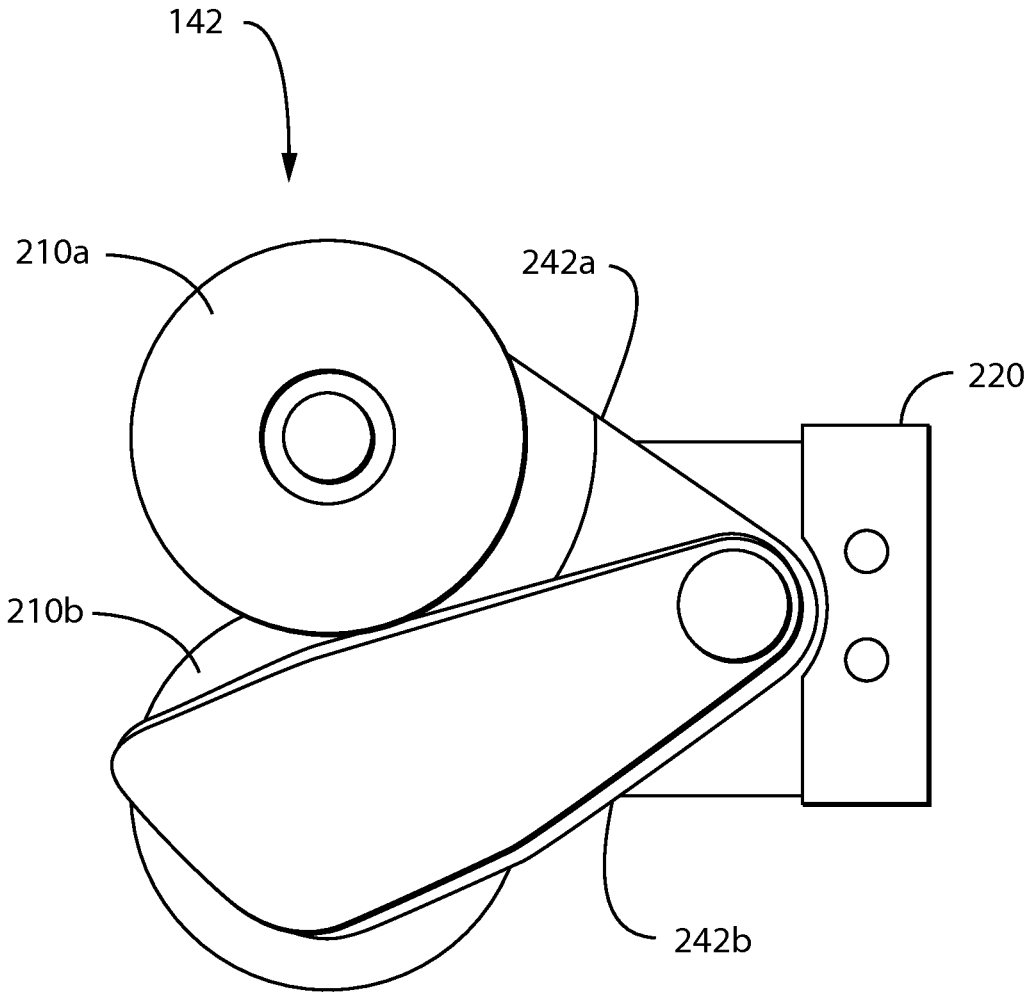
FIG. 2 depicts an embodiment of a pair of arms with wheels located at the ends thereof.

FIG. 2 depicts an embodiment of a pair of arms with wheels located at the ends thereof. The depicted pair of arms 142 has a first arm 242*a* and a second arm 242*b*. The first arm 242*a* can have a first wheel 210*a* connected therewith, and the second arm 242*b* can have a second wheel 210*b* connected therewith. An actuator 220 can be connected with the arms 242*a* and 242*b*.

The arms 242*a* and 242*b* are depicted assembled in such a way that they are self-cleaning. The arms 242*a* and 242*b* can be made from any material. Illustrative materials include: steel, aluminum, composites, or the like.

Figure 3:
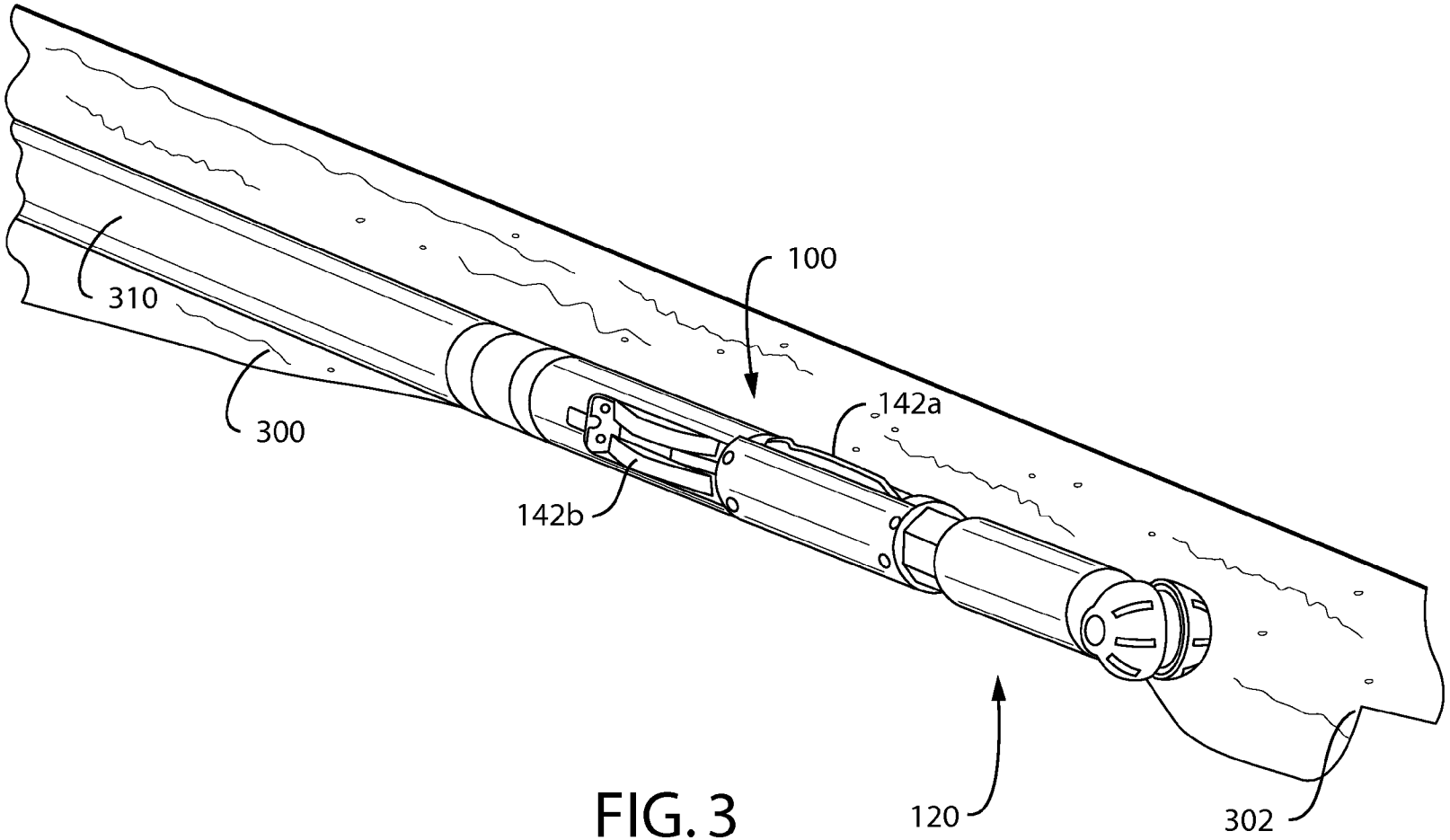
FIG. 3 depicts an embodiment of an apparatus connected with a toolstring in a well.
Figure 4:
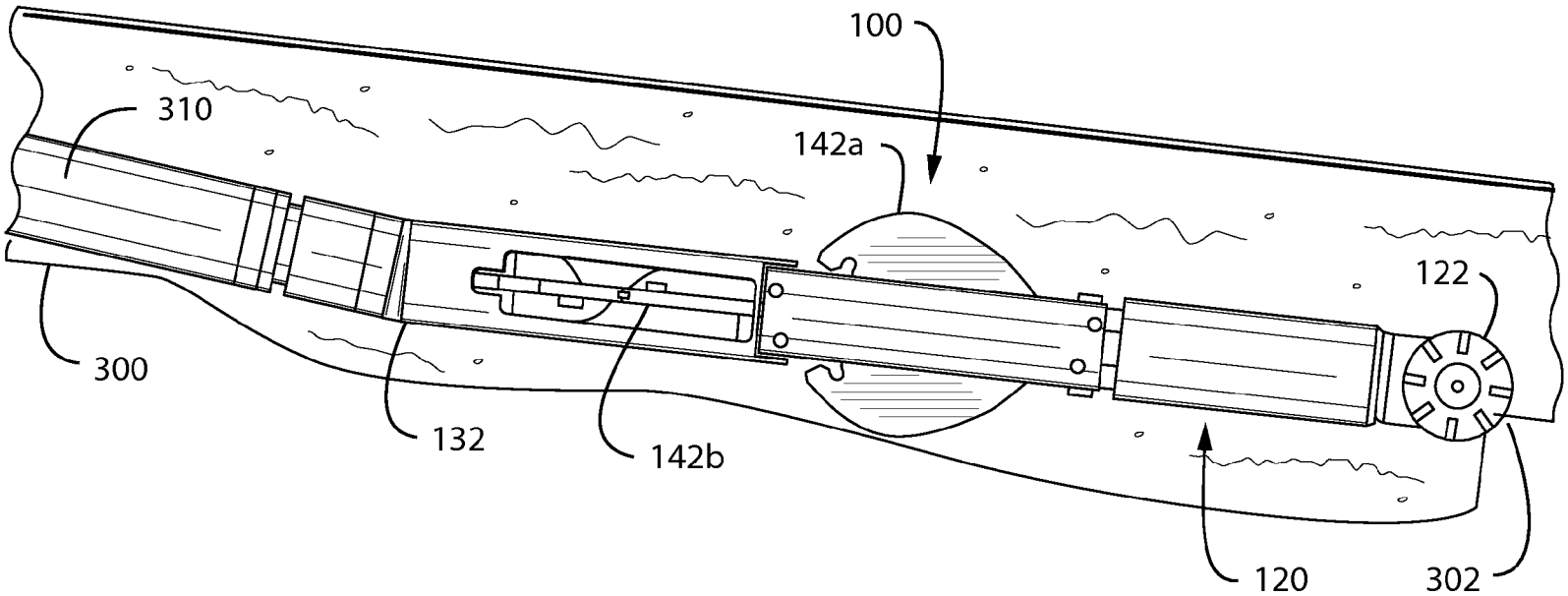
FIG. 4 depicts the apparatus and toolstring of FIG. 3 in the well when an obstruction is encountered.
Figure 5:
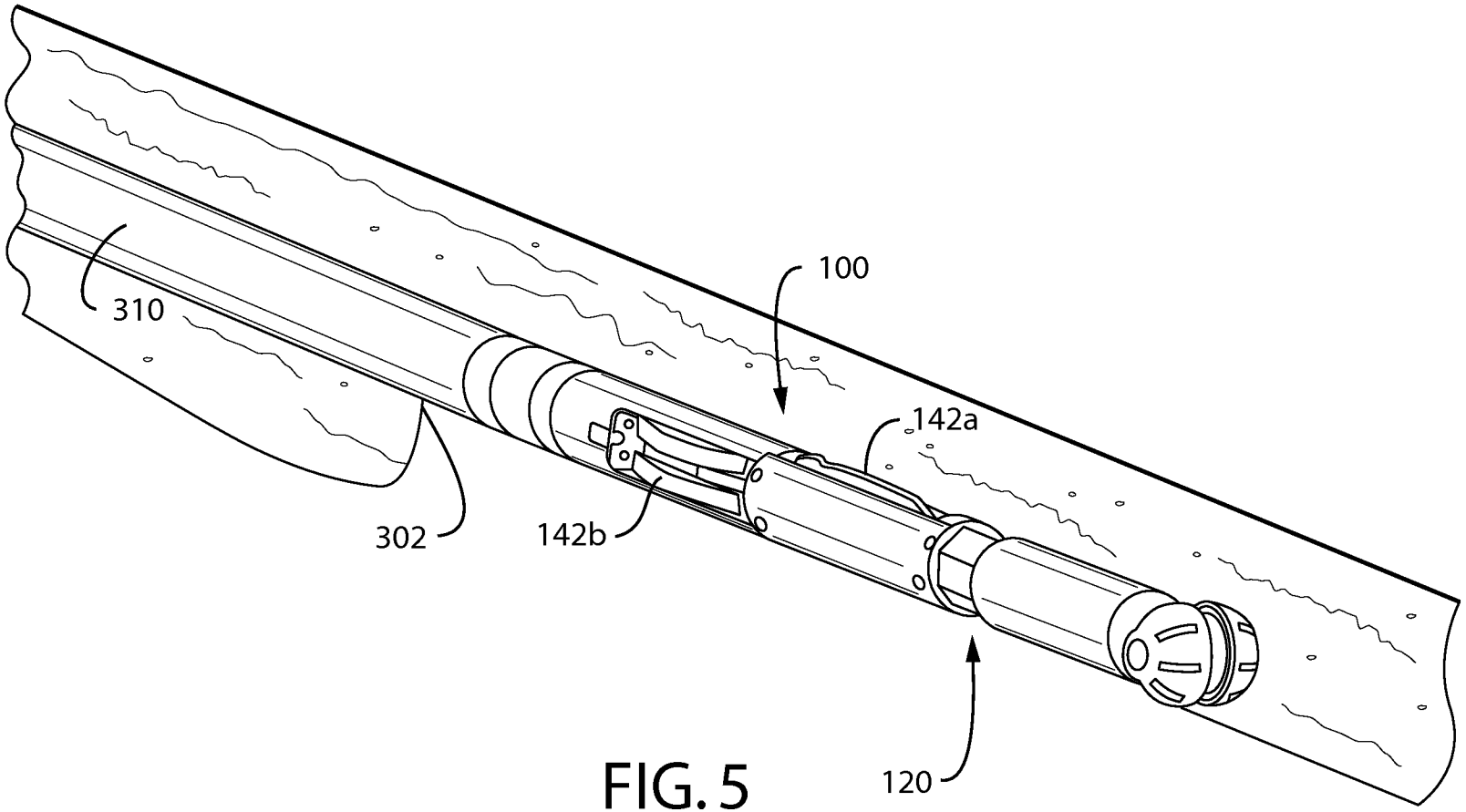
FIG. 5 depicts the apparatus and toolstring of FIG. 4 in the well after the obstruction is negotiated.

FIG. 3 depicts an embodiment of an apparatus connected with a toolstring in a well. FIG. 4 depicts the apparatus and toolstring of FIG. 3 in the well when an obstruction is encountered. FIG. 5 depicts the apparatus and toolstring of FIG. 4 in the well after the obstruction is negotiated.

Referring to FIGS. 3 to 5, the apparatus 100 can connect with a toolstring 310. The apparatus 100 and toolstring 310 can be run into the well 300. The toolstring 310 can include a plurality of downhole tools connected with one another. The downhole tools can include logging tools, perforating tools, or other downhole tools.

The well 300 can have an obstruction 302 therein. The obstruction 302 can be a ledge, debris, or the like. The obstruction can be due to a washout in the well 300.

The nose 120 contacts the obstruction 302, and an axial force is imparted to the nose 120 from the obstruction 302. The axial force moves the nose 120, and the nose 120 transfers the force to the pair of arms 142*a* and 142*b*, radially expanding the arms. The arms centralize the nose 120, and the pair of rollers 122 starts traversing the obstruction 302.

The ball joint 132 allows the apparatus 100 to move relative to the toolstring 310. Accordingly, the toolstring 310 is able to navigate the obstruction 302 by using mechanics and force already present in the well. The apparatus 100 allows navigation of the obstruction and does not require any auxiliary power, such as hydraulic power or electric power.

The toolstring 310 and nose 120 continue traversing the well 300 and eventually the nose 120 passes the obstruction 302. The nose 120, now that the axial force from the obstruction 302 is removed, moves away from the pairs of arms 142*a* and 142*b*, and the pair of arms 142*a* and 142*b* can return to their original unexpanded state. Force from the interaction of the pair of arms 142*a* and 142*b* with walls of the well 300, a return mechanism, or both can move the pair of arms 142*a* and 142*b* to an unexpanded position.

Figure 6:
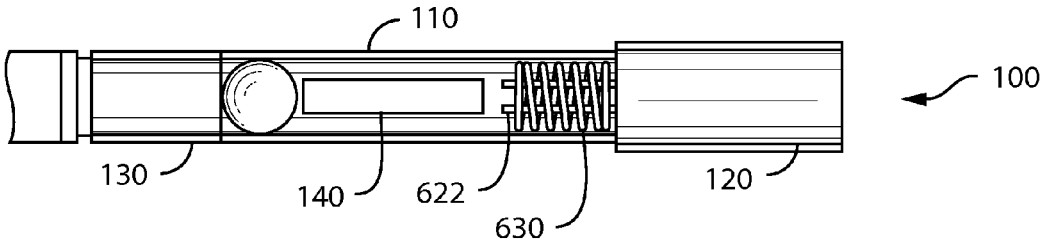
FIG. 6 is a schematic cross-sectional view of an embodiment of the apparatus.

FIG. 6 is a schematic cross-sectional view of an embodiment of the apparatus. The apparatus 100 can have the nose 120, the centralizer 140, and the connection member 130 connected with the elongated body 110. The nose 120 can have push rods 622 connected therewith.

A return mechanism 630 can be located between the nose 120 and the centralizer 140. The push rods 622 can actuate the centralizer 140 as the nose moves due to an axial force being applied to it. The return mechanism 630 can urge the nose 120 away from the centralizer 140 once the axial force is removed from the nose 120. The return mechanism 622 and force from the interaction of the centralizer with walls of the well can move the centralizer to an unexpanded position.

In an embodiment, two push rods can be connected with the nose. A first pair of arms can be operatively connected with a first actuator, such as a first sliding block, and a second pair of arms can be operatively connected with a second actuator, such as a second sliding block.

The first sliding block can have two holes formed therethrough. The holes can be aligned with the push rods. The two holes can be configured such that force from the push rods are transferred to the first sliding block, causing the first sliding block to move as the push rods are in the two holes.

Accordingly, the push rods can extend into the holes when the nose is pushed back. The push rods can pass through the holes and transfer force from the nose to the first actuator.

The push rods can operatively encounter the second actuator after passing through the first actuator. The push rods can move the second actuator when engaged therewith. The push rods can still be moving the first actuator at the same time that they are moving the second actuator.

The second actuator can be void of holes, have indents, have two holes formed therein, or combinations thereof. If the second actuator has two holes formed therein, the two holes can be operatively aligned with the push rods. The two holes in the second actuator can pass completely through a body of the second actuator or a portion of the way through the body of the second actuator.

In another embodiment, the push rods can encounter the first actuator. The push rods can move the first actuator. A part of the first actuator or a component connected with the first actuator can engage the second actuator when the first actuator is in a desired location. The desired location can be when the first actuator is in a start position, allowing the first pair of arms and second pair of arms to deploy concurrently. The desired location can be a distance from the start location, allowing the first pair of arms to start deploying before the second pair of arms.

Figure 7:
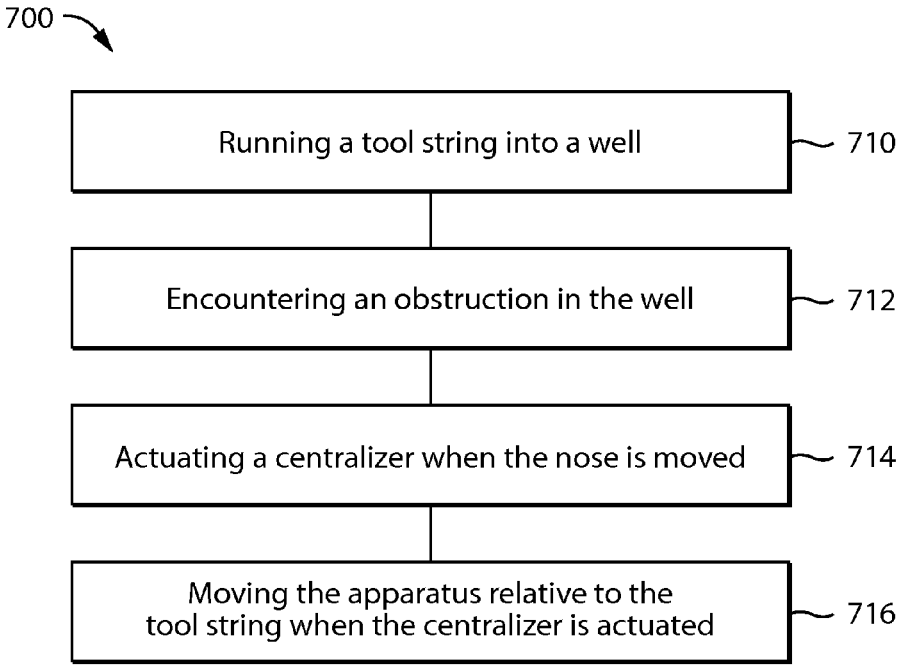
FIG. 7 depicts an embodiment of a method of negotiating obstructions while running a toolstring in a well.

FIG. 7 depicts an embodiment of a method of negotiating obstructions while running a toolstring in a well.

The method 700 is depicted as a plurality of blocks or operations. The method 700 includes running a toolstring into a well (Block 710). The toolstring can be run into the well using a cable.

The cable can be a wireline, slickline, or the like. The cable can be connected with a drum and supported by a derrick. The drum can deploy the cable.

A capstan can be located between the drum and derrick, and the capstan can reduce the tension on the cable. In another embodiment, a winch or other device can be used to deploy the cable.

The method also includes encountering an obstruction in the well (Block 712). The obstruction can be encountered as the toolstring is deployed. The obstruction can be a nipple, a washout, a ledge, debris, or the like. The obstruction applies an axial force to a nose of an apparatus located at the distal end of the toolstring, moving the nose.

The method also includes actuating a centralizer when the nose is moved (Block 714). The centralizer can be actuated when mechanically force is transferred from the nose to the centralizer.

The method can also include moving the apparatus relative to the toolstring when the centralizer is actuated (Block 716). For example, the nose can be connected with the toolstring by a ball joint or the like, allowing for the nose to move radially relative to the toolstring.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. An apparatus to allow a tool string to negotiate obstructions in a well, wherein the apparatus comprises:

an elongated body comprising a first end and a second end, wherein a first pair of arms that radially expand in a first arc towards the second end is located on the elongated body between the first end and a second pair of arms, wherein the second pair of arms radially expand in a second arc towards the first end, and wherein the second pair of arms is located on the elongated body between the first pair of arms and the second end;

a nose connected to the first end of the elongated body, wherein the nose is configured to move axially relative to the elongated body when force is exerted on the nose from an obstruction in a well, and wherein the nose transfers the force from the obstruction to an actuator that causes the first pair of arms to radially expand in the first arc towards the first end and the second pair of arms to radially expand in the second towards the second end; and a connection member connected to the second end, wherein the connection member connects to the elongated body and another connection for connecting to a tubular string, wherein the connection member allows the elongated body to pivot relative to the tubular string.

2. The apparatus of claim 1, wherein each of the arms has a wheel connected therewith.

3. The apparatus of claim 1, further comprising a return mechanism between the nose and the pairs of arms.

4. The apparatus of claim 1, wherein the nose comprises a pair of rollers on an end thereof opposite of an end connected with the first end of the elongated body.

5. A system for use in a wellbore, wherein the system comprises:

an apparatus, wherein the apparatus comprises:

an elongated body comprising a first end and a second end, wherein a first pair of arms that radially expand in a first arc towards the second end is located on the elongated body between the first end and a second pair of arms, wherein the second pair of arms radially expand in a second arc towards the first end, and wherein the second pair of arms is located on the elongated body between the first pair of arms and the second end;

a nose connected to the first end of the elongated body, wherein the nose is configured to move axially relative to the elongated body when force is exerted on the nose from an obstruction in a well, and wherein the nose transfers the force from the obstruction to an actuator that causes the first and second pair of arms to radially expand; and a connection member connected to the second end, wherein the connection member is connected with the elongated body; and a toolstring connected with connection member.

6. The apparatus of claim 5, wherein each of the arms has a wheel connected therewith.

7. The apparatus of claim 5, further comprising a return mechanism between the nose and the pairs of arms.

8. The apparatus of claim 5, wherein the nose comprises a pair of rollers on an end thereof opposite of an end connected with the first end of the elongated body.

9. A method of negotiating obstructions while running a toolstring in a well, wherein the method comprises:

running a toolstring in a wellbore, wherein the toolstring is connected to an apparatus, wherein the apparatus comprises:

an elongated body comprising a first end and a second end, wherein a first pair of arms that radially expand in a first arc towards the second end is located on the elongated body between the first end and a second pair of arms, wherein the second pair of arms radially expand in a second arc towards the first end, and wherein the second pair of arms is located on the elongated body between the first pair of arms and the second end;

a nose connected to the first end of the elongated body, wherein the nose is configured to move axially relative to the elongated body when force is exerted on the nose from an obstruction in a well, and wherein the nose transfers the force from the obstruction to actuators that cause the first and second pair of arms to radially expand; and a connection member connected to the second end, wherein the connection member is connected with the elongated body with a ball joint and is connected to the toolstring at another end opposite the ball joint;

engaging the nose with an obstruction, wherein force from the nose engaging the obstruction moves the nose towards the elongated body, and wherein the nose transfers the force to an actuator to radially expand the pairs of arms; and moving the nose and elongated body relative to the toolstring when the arms radially expand, allowing the nose and elongated body to traverse the obstruction.

10. The method of claim 9, wherein each of the arms has a wheel connected therewith.

11. The method of claim 9, further comprising a return mechanism between the nose and the pairs of arms.

12. The method of claim 9, wherein the nose comprises a pair of rollers on an end thereof opposite of an end connected with the first end of the elongated body.

* * * * *